United States Patent [19]

Haahtikivi et al.

[11] Patent Number: 5,036,954

[45] Date of Patent: Aug. 6, 1991

[54] ELEVATOR

[75] Inventors: Kari Haahtikivi, Hyvinkaa; Reijo Silvola, Jarvenpaa, both of Finland

[73] Assignee: KONE Elevator GmbH, Switzerland

[21] Appl. No.: 416,773

[22] Filed: Oct. 4, 1989

[30] Foreign Application Priority Data

Oct. 4, 1988 [FI] Finland ..... 884560

[51] Int. Cl.[5] ..... B66B 7/02

[52] U.S. Cl. ..... 187/95; 187/94; 187/20

[58] Field of Search ..... 16/1 C; 187/20, 26, 187/94, 95; 248/297.1, 331, 364

[56] References Cited

U.S. PATENT DOCUMENTS

| | | | |
|---|---|---|---|
| 1,093,583 | 4/1914 | Fraser | 187/20 |
| 1,277,567 | 9/1918 | Garrison | 187/94 |
| 1,419,783 | 6/1922 | Julien | 187/20 X |
| 3,738,455 | 6/1973 | Tintoré | 187/94 X |
| 3,845,842 | 11/1974 | Johnson | 187/95 X |
| 4,592,450 | 6/1986 | Schaffer | 187/95 X |

*Primary Examiner*—Joseph E. Valenza
*Assistant Examiner*—Dean A. Reichard
*Attorney, Agent, or Firm*—Lowe, Price, LeBlanc and Becker

[57] ABSTRACT

To increase the transportation capacity in relation to shaft volume, of an elevator comprising an elevator shaft with guide rails on which the elevator car and its counterweight move, the ropes on which the car and counterweight are suspended, and a traction sheave, whose motion is transmitted to the car and counterweight by the ropes, the rail length provided for the travel of the counterweight is shorter than the rail length provided for the travel of the elevator car.

15 Claims, 1 Drawing Sheet

ELEVATOR

BACKGROUND OF THE INVENTION

1. Field of the Invention

The present invention relates to an elevator comprising an elevator shaft with guide rails on which the elevator car and its counterweight move, the ropes on which the car and counterweight are suspended, and a traction sheave, whose motion is transmitted to the car and counterweight by the ropes.

2. Description of Related Art

To increase the transportation capacity of an elevator in relation to the total volume of the elevator structures, an expedient commonly used is to increase the transportation capacity relative to time e.g. by increasing the travelling speed of the elevator or by appropriate arrangements in the organization of elevator traffic, e.g. by shortening the stays at floor levels between stopping and departure.

Another way to increase the transportation capacity in relation to the volume of the elevator structures is to reduce the total volume of the elevator. To achieve a reduction in the total volume, it is hardly possible to reduce the size of the machine room to any significant extent. Neither can the height of the elevator shaft be reduced without reducing the travel height or speed of the elevator.

Thus, the only recourse available is to increase the ratio of the area of the horizontal section of the elevator car to the sectional area of the shaft. To achieve this, the layout of the elevator components on the transverse plane in the shaft is generally designed with a view to increasing the car area. In the transverse layout, within the limitations imposed by the functional properties of the components, a nearly optimum state has already been achieved.

Another problem with current elevator suspension arrangements where the counterweight speed and travel are equal to those of the car is that, in cases of failure where the car and counterweight "break loose", the sudden stop resulting from the action of the safety gear leads to a so-called bound of the counterweight, for which reason the elevator shaft must provide enough headroom for this counterweight bound at the upper end to avoid damage to the machinery or the shaft ceiling.

Another factor which imposes certain restrictions on the design of the elevator shaft is the height of the counterweight, because the counterweight travel is essentially equal to the car travel.

SUMMARY OF THE INVENTION

The object of the present invention is to increase the transportation capacity of the elevator in relation to the shaft volume and to eliminate or at least to reduce the counterweight bound referred to above. The invention also aims at providing greater freedon of design regarding the height of the counterweight to facilitate the design of the elevator shaft. This invention, by shortening the travel of the counterweight relative to the travel of the elevator car, reduces the average relative area occupied by the counterweight in the transverse section of the elevator shaft while also reducing the proportion of shaft volume required by the counterweight when moving along the guide rails in the shaft.

The elevator of the invention is characterized in that the rail length provided for the travel of the counterweight is shorter than the rail length provided for the travel of the elevator car.

A preferred embodiment of the elevator of the invention is characterized in that the shortened counterweight travel is achieved by using at least one diverter pulley to render the counterweight roping ratio larger than the car roping ratio.

Another preferred embodiment of the elevator of the invention is characterized in that the counterweight travel equals approximately half the travel of the elevator car and that the counterweight moves along a track located in the upper part of the elevator shaft.

Yet another preferred embodiment of the elevator of the invention is characterized in that the counterweight is approximately 5–8 m high. Preferably the counterweight is as thin as possible.

The invention offers several advantages over previously known techniques. Among the most important are: A better volume/capacity ratio, i.e. part of the shaft space previously occupied by the counterweight can be used for other purposes. Since the guide track is shorter, less material is needed for the rails and rail mounting accessories. Further, a shorter partition meshwork is needed, if applicable. The lower counterweight speed resulting from the shorter travel allows the use of a smaller and cheaper buffer, possibly enabling a spring buffer to be used instead of an oil buffer. Moreover, it is possible to apply a higher limit speed for the use of the tension weights on the compensating ropes because the counterweight bound resulting from the action of the car safety gear is smaller (proportional to the square of the speed). The resulting strain on the gear wheels in the gear assembly is reduced. Also, less headroom for counterweight bound is required.

Further economies are achieved in the installation work, because, due to the shorter guide rail track, there is less to install and it is easier to get the rails aligned. The relative speed at which the elevator car and counterweight meet in the shaft is lower, which means that the pressure impact which causes the car to sway is also reduced. On account of the shorter rail track, the strain imposed on the rails by the deformations, swinging or settling of the building is reduced. In addition to new buildings, the invention is also applicable to the modernization of old elevators, because it enables the elevator capacity to be increased by as much as 20%.

BRIEF DESCRIPTION OF THE DRAWINGS

In the following, the invention is described by the aid of examples of preferred embodiments, reference being made to the drawings attached, wherein.

DESCRIPTION OF PREFERRED EMBODIMENTS

Figure 1:
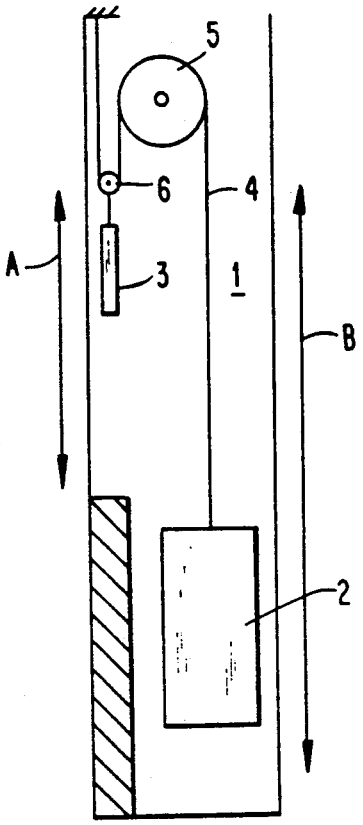
FIG. 1 presents an embodiment of the elevator of the invention in diagrammatic form, seen from the side.

In FIG. 1, the elevator car 2 and the counterweight 3 move along their respective guide rails (not shown) in the elevator shaft 1. The elevator also comprises the suspension ropes 4 supporting the car 2 and counterweight and transmitting the motion from the traction sheave 5 to the car 2 and counterweight 3. The suspension ropes 4 pass around at least one diverter pulley 6 in such manner that the counterweight roping ratio is larger than the car roping ratio. In this manner, the travel A of the counterweight 3 is shortened and can equal e.g. half the travel B of the car 2. On account of the shorter counterweight travel, the transportation capacity of the elevator in relation to the shaft volume is increased. The increased capacity can be utilized in many ways. In the case of the embodiment in FIG. 1, in which arrow A indicates the range of movement of the counterweight 3 and arrow B the range of movement of the elevator car 2, the shaft space thus left free below the counterweight track can be used for other purposes in the building.

Figure 2:
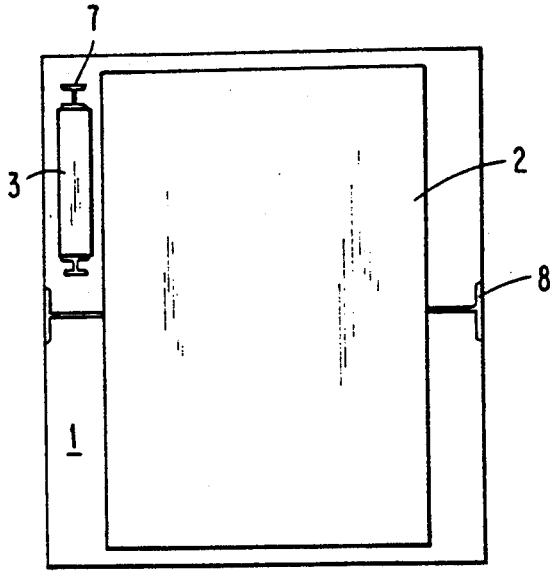
FIG. 2 presents another embodiment of the elevator of the invention in diagrammatic form, seen from above.

In the embodiment in FIG. 2, the counterweight 3, which moves along guide rails 7, is located at the side of the elevator car 2, which moves along guide rails 8. Because spaces must be provided for the automatic doors at the sides of the car 2, the counterweight 3 can also be placed in this space. The counterweight 3 in this embodiment is narrower than usual but its height has been increased correspondingly, which is possible because the counterweight travel is shorter than the car travel.

Figure 3:
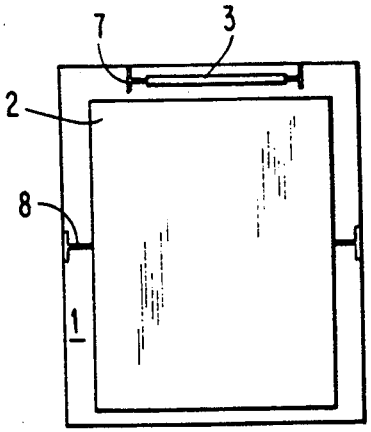
FIG. 3 presents a third embodiment of the elevator of the invention in diagrammatic form, seen from above.

FIG. 3 shows an embodiment in which the counterweight 3 is as thin as possible but also considerably higher than usual, e.g. about 5–8 m. This makes it possible to increase the depth dimension of the elevator car 2.

Figure 4:
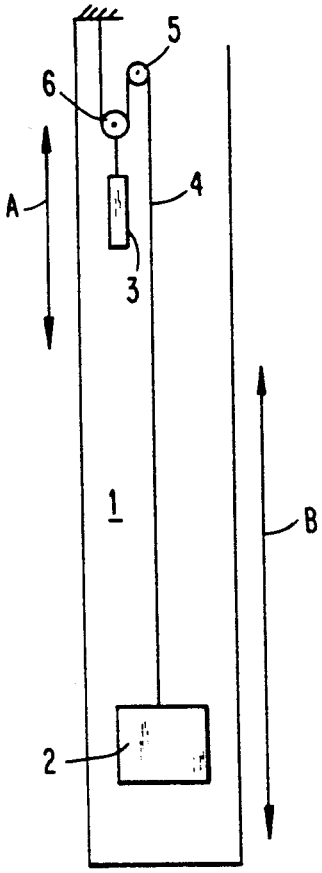
FIG. 4 shows a diagram of a fourth embodiment of the elevator of the invention, seen from the side.

FIG. 4 shows an embodiment in which the counterweight track A is entirely above the car track B. Such an arrangement is especially suited for elevators serving a "low zone" and having their machine room higher up in the building. Thus the counterweight 3 takes up no shaft space at all within the territory of the car 2. This allows the size of the car 2 to be increased or the space reserved for the counterweight 3 to be used for other purposes in the building. The buffer (not shown) of the counterweight 3 is placed on a steel beam in the shaft 1.

It is obvious to a person skilled in the art that the invention is not restricted to the examples of its embodiments described above, but that it may instead be varied within the scope of the following claims.

We claim:

1. In an elevator comprising an elevator shaft with guide rails on which an elevator car and its counterweight may move, ropes on which said elevator car and counterweight are suspended, and a traction sheave the motion of which is transmitted to the car and counterweight by said ropes, the improvement comprising providing a guide rail for said counterweight which is of shorter length than the length of guide rail provided for the elevator car, wherein the counterweight guide rail is located in the upper part of the elevator shaft, and providing means whereby the travel length of said counterweight is shorter than the travel length of said elevator car, whereby to achieve an increased ratio between the horizontal sectional area of the elevator car and the horizontal sectional area of the shaft.

2. An improved elevator according to claim 1, wherein the means for shortening the travel length of said counterweight comprises at least one diverter pulley to render the roping ratio of said counterweight larger than the roping ratio of said elevator car.

3. An improved elevator according to claim 1, configured such that in operation, said counterweight travels approximately half the distance that said elevator car travels.

4. An improved elevator according to claim 2, configured such that in operation said counterweight travels approximately half the distance that said elevator car travels.

5. An improved elevator according to claim 1, wherein the length of said counterweight is in the range from approximately 5 meters to approximately 8 meters in length with a narrow horizontal section.

6. An improved elevator according to claim 2, wherein the length of said counterweight is in the range from approximately 5 meters to approximately 8 meters in length with a narrow horizontal section.

7. An improved elevator according to claim 3, wherein the length of said counterweight is in the range from approximately 5 meters to approximately 8 meters in length with a narrow horizontal section.

8. An improved elevator according to claim 4, wherein the length of said counterweight is in the range from approximately 5 meters to approximately 8 meters in length with a narrow horizontal section.

9. An improved elevator according to claim 1, wherein a guide rail for said counterweight is entirely above a guide rail for said elevator car.

10. An improved elevator according to claim 2, wherein a guide rail for said counterweight is entirely above a guide rail for said elevator car.

11. An improved elevator according to claim 3, wherein a guide rail for said counterweight is entirely above a guide rail for said elevator car.

12. In an elevator comprising an elevator shaft with guide rails on which an elevator car and its counterweight may move, ropes on which said elevator car and counterweight are suspended, and a traction sheave the motion of which is transmitted to the car and counterweight by said ropes, the improvement comprising providing a guide rail for said counterweight which is of shorter length than the length of guide rail provided for the elevator car, wherein the counterweight guide rail is located in the upper part of the elevator shaft, and providing means whereby the travel length of said counterweight is shorter than the travel length of said elevator car, and wherein the counterweight is disposed vertically over said elevator car, whereby to achieve an increased ratio between the horizontal sectional area of the elevator car and the horizontal sectional area of the shaft.

13. An improved elevator according to claim 12, wherein the means whereby the travel length of said counterweight is shortened comprises at least one diverter pulley to render the roping ratio of said counterweight larger than the roping ratio of said elevator car.

14. An improved elevator according to claim 12, configured such that in operation, said counterweight travels approximately half the distance that said elevator car travels.

15. An improved elevator according to claim 13, configured such that in operation said counterweight travels approximately half the distance that said elevator car travels.

* * * * *